United States Patent [19]

Huszagh

[11] Patent Number: 4,529,127

[45] Date of Patent: Jul. 16, 1985

[54] MACHINE FOR APPLYING A TWO COMPONENT RESIN TO A ROADWAY SURFACE

[75] Inventor: Donald W. Huszagh, Bayport, N.Y.

[73] Assignee: The United States of America as represented by the United States Department of Energy, Washington, D.C.

[21] Appl. No.: 488,306

[22] Filed: Apr. 25, 1983

[51] Int. Cl.[3] ..... B05B 15/02

[52] U.S. Cl. ..... 239/112; 239/127; 239/128

[58] Field of Search ..... 239/106, 112, 159, 127, 239/128, 113, 131

[56] References Cited

U.S. PATENT DOCUMENTS

| | | | |
|---|---|---|---|
| 2,875,675 | 3/1959 | Searight . | |
| 2,899,929 | 8/1959 | Monroe . | |
| 3,230,843 | 1/1966 | Santucci . | |
| 3,385,522 | 5/1968 | Kock . | |
| 3,403,695 | 10/1968 | Hopkins | 239/112 |
| 3,662,953 | 5/1972 | Wiens | 239/159 X |
| 3,682,054 | 8/1972 | MacPhail et al. . | |
| 4,109,033 | 8/1978 | Blankenhorn et al. . | |
| 4,153,743 | 5/1979 | Caramanian . | |
| 4,311,274 | 1/1982 | Neal . | |
| 4,316,750 | 2/1982 | Gengler . | |

*Primary Examiner*—Andres Kashnikow
*Assistant Examiner*—Daniel R. Edelbrock
*Attorney, Agent, or Firm*—Vale P. Myles; Paul A. Gottlieb; Judson R. Hightower

[57] ABSTRACT

A portable machine for spraying two component resins onto a roadway, the machine having a pneumatic control system, including apparatus for purging the machine of mixed resin with air and then removing remaining resin with solvent. Interlocks prevent contamination of solvent and resin, and mixed resin can be purged in the event of a power failure.

10 Claims, 2 Drawing Figures

MACHINE FOR APPLYING A TWO COMPONENT RESIN TO A ROADWAY SURFACE

BACKGROUND OF THE INVENTION

The U.S. Government has rights in this invention purusant to Contract Number DE-AC02-76CH00016, between the U.S. Department of Energy and Associated Universities, Inc.

This invention relates to a fluid spraying machine and particularly to a portable machine for spraying quick setting resins onto a roadway.

During recent years two component resin compositions have been developed for industrial and commercial uses. These resins, which consist of a resin material and a hardener or curing agent, are maintained as separate viscous liquids until they are mixed together, at which time a thermal reaction takes place resulting in the liquid becoming a solid which has a combination of properties extremely useful in a wide variety of applications.

One application for these resins is as an overlay or coating for road surfaces. If a resin coating is applied to the road surface and sand or other aggregate spread over the surface prior to its setting, a tough, coarse and relatively impenetrable weather resistant surface is obtained, thereby protecting and extending the life of the road surface.

In order to apply the resin, it is necessary to have a machine capable of maintaining the two components of the resin at suitable temperatures prior to mixing, and then effectively mixing the resin components and applying them to the roadway at a controlled rate. Due to the quick setting nature of the resin when it has been mixed with the curing agent or hardener, it is essential that provisions be made for effectively and simply cleaning the machine once spraying has stopped to prevent hardening of the resin mixture in the machine. The machine should be simple to operate and failsafe so that in the event of a loss of power or failure of any components of the machine the operator can discharge all of the activated resin which has been mixed and clean the machine to ensure that the mixed resin does not harden in the mixing chamber or spray nozzles of the machine. In addition, the machine should have interlocks which prevent improper operation of the machine such as the introduction of solvent during application of the resin to the roadway.

BRIEF DESCRIPTION OF THE INVENTION

The present invention provides a pneumatically controlled machine for spraying quick setting resins onto a roadway and includes an ice water cooling system to control the temperature of the resin and curing agent, as well as a circulating system for keeping the resin and the curing agent "fresh" prior to their mixing. In addition, the machine provides a flushing and cleaning system which utilizes a minimum of solvent and in which pressurized air is used to purge the system of excess mixed resin prior to cleaning with a solvent and in which pressurized air is used to remove excess solvent after cleaning. The machine is failsafe so that in the event of a failure of the pumps or electrical system the available compressed air can be used to purge the system and flush it with solvent to remove any mixed resin, thereby preventing the resin from hardening in the mixing chamber and spraying mechanism.

DESCRIPTION OF THE PREFERRED EMBODIMENT

Figure 1:
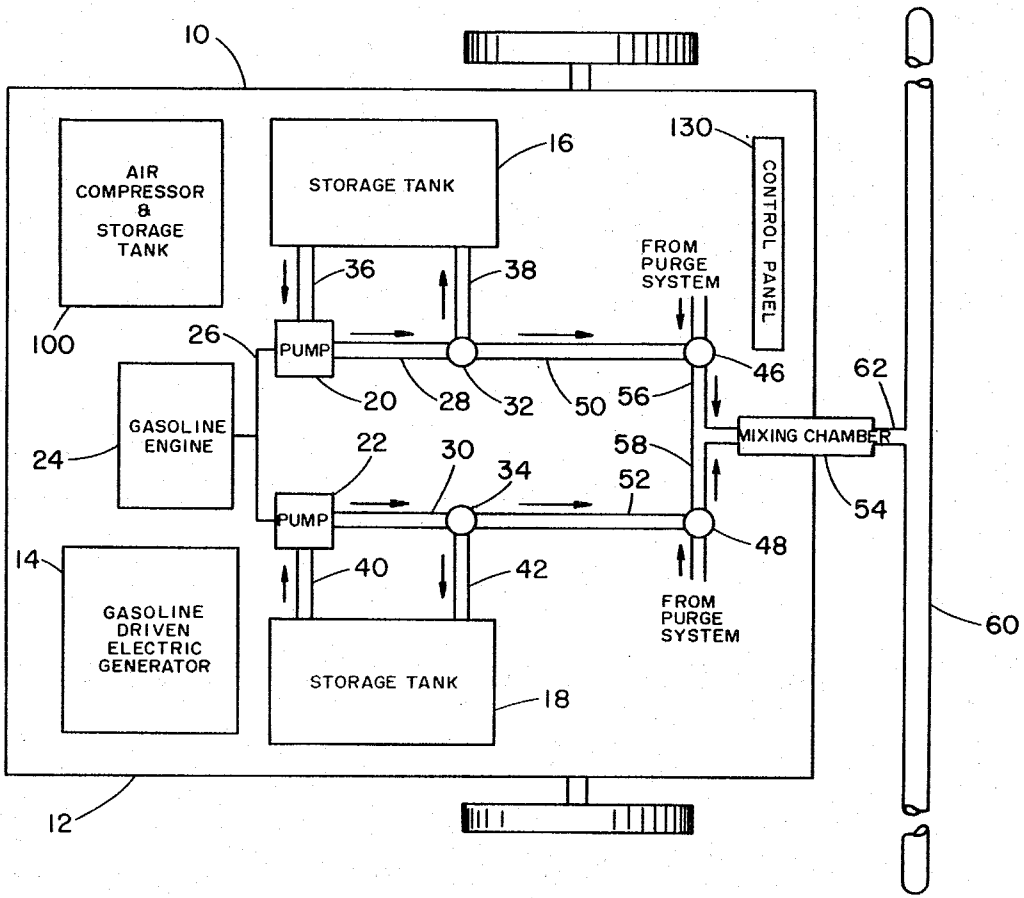
FIG. 1 is a plan view of a mobile apparatus showing a preferred embodiment of the present invention.

Referring to FIG. 1, there is shown a truck 10 which includes a chassis 12 on which a spraying apparatus is mounted. A gasoline driven electric generator set 14 provides electricity for the system, as well as sufficient electricity to operate portable tools and auxiliary lighting. The major components of the resin spray system include a storage tank 16 for the resin, a storage tank 18 for the curing agent, vane pumps 20 and 22 for the resin and the curing agent respectively, and a gasoline driven engine 24 for driving the pumps through an integral reduction gear and mechanical clutch and drive chain 26. The outlet lines 28 and 30 of the pumps 20 and 22 are connected to air actuated ball valves 32 and 34 respectively, which act as diverter valves, as explained below. The outlet of the storage tank 16 is connected to the inlet of the pump 20 via line 36, while a return line 38 connects one outlet of the valve 32 to the storage tank 16. Similarly, the outlet of the curing agent storage tank 18 is connected to the pump via line 40, while the line 42 provides a return to the storage tank from the pump 22. A second pair of three-way air actuated ball valves 46 and 48 are connected to the discharge lines 50 and 52 of the diverter valves 32 and 34 respectively. The outlets of the valves 46 and 48 are connected to a static mixing chamber 54 via the lines 56 and 58, so valves 46 and 48 are designated mixing chamber valves herein. A horizontal header or spray manifold 60 is connected to the mixer 54 via the line 62. The spray manifold, which includes a series of equally spaced spray nozzles along its underside, can be raised or lowered so that the clearance between the spray manifold and the roadway can be adjusted. In addition, the spray manifold may be angled with respect to the road direction to compensate for different road widths.

Figure 2:
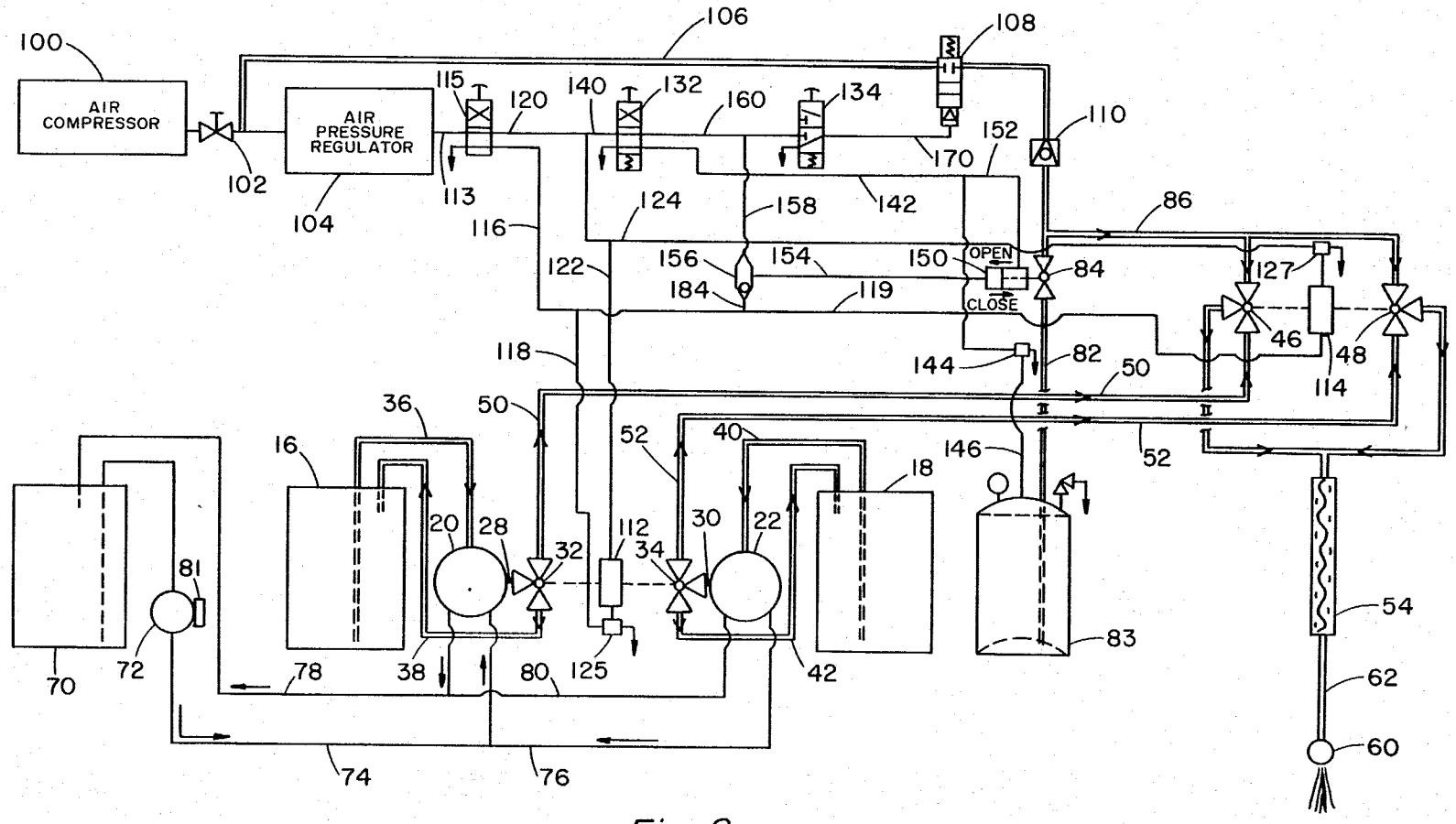
FIG. 2 is a schematic view showing the control system for the apparatus of FIG. 1.

Referring now to FIG. 2, heat exchange means for cooling the resin components are supplied by having ice water, or other cooling fluid, circulated through the water jackets of the resin pump 20 and the curing agent pump 22 from a storage tank 70 via an electric pump 72 and lines 74, 76, 78, and 80. The electric pump is thermostatically controlled via a thermostat 81 to maintain the temperature of the resin and curing agent within a predetermined range.

A solvent storage tank 83 is connected to inlets of the valves 46 and 48 via line 82, a ball valve 84, and line 86.

All functions are controlled by a pneumatic air system, which includes an electrically driven air compressor and storage tank 100, to provide a source of compressed air, a shut-off valve 102, and an air pressure regulator 104. All of the pneumatic control lines are one-quarter inch tubing, except for the the one-half inch line 106, which directly connects the compressor outlet to the large bore control valve 108, the outlet of which is connected to the pipe 86 via a check valve 110. The valves 32 and 34 are coupled to a double shafted pneumatic valve actuator 112, so that they always operate in unison. Similarly, a double shafted pneumatic valve actuator 114 controls the valves 46 and 48 so that they also act in unison. The actuators 112 and 114 are connected to a two-position four-way manual pneumatic-flow control valve 115 via line 116, which branches to form lines 118 and 119, connected to one side of the actuators 112 and 114 respectively, and a line 120 which branches to form line 122 and line 124 connected to the other sides of the actuators 112 and 114 respectively. A quick exhaust valve 125 is located in line 118 and a similar quick exhaust valve 127 is located in line 124.

The control valve 115 is mounted on a control panel 130 shown in FIG. 1 along with the push button spring-return four-way control valve 132, and push button spring-return three-way valve 134. The inlet of valve 132 is connected to the air supply via line 140, line 120, and then valve 115. A line 142 connects valve 132 to the solvent storage vessel 83 via a quick exhaust valve 144, and line 146. The valve 132 is also connected to the open side of the ball valve control actuator 150 via a line 152. The close side of the ball valve actuator is connected to solvent supply actuator valve 132 via line 154, shuttle valve 156, line 158, and line 160. The opposite side of the shuttle valve 156 is connected to line 119. The air purge release valve 108 is connected to the air supply via line 170, three-way spring-return push button air supply actuator valve 134, line 160, valve 132, and valve 115.

OPERATION OF THE SYSTEM

There are four modes of operation of the system, all controlled by the three valves (115, 132 and 134) on the control panel 130. Prior to the mixing and spraying operation, the resin flow control valve 115 is in the "out" position, in which compressed air from the regulator 104 passes through the valve via lines 113, 120, and to the resin control valve actuators 112 and 114 via lines 122 and 124. In this mode of operation, the diverter valve 32 connects the outlet of the pump 20 to the return line 38 of the storage tank 16, so that the resin is continuously circulated to maintain its "freshness". Similarly, diverter valve 34 directs the outlet of the pump 22 to the tank 18 via pipe 42, thereby circulating the curing agent for the same purpose. The pump 72, which may be thermostatically controlled, circulates ice water or other cooling fluid through the water jackets of the pumps 20 and 22 from a supply tank 70, thereby maintaining the temperature of the resin and curing agent at a level sufficient to ensure curing in the desired time after mixing. The other sides of the actuators 112 and 114 are connected to the flow control valve 115 via lines 116, 118, and 119. A quick exhaust valve 125 in line 118 ensures that the diverter valves 32 and 34 will divert the resin and hardening agent flow to the recirculation mode prior to the closing of the mixing chamber valves 46 and 48.

When the operator desires to spray resin on the road surface, the valve 115 is pushed "in", thereby reversing the pressures on the actuators 112 and 114. The quick exhaust valve 127 in line 124 ensures that the mixing chamber valves 46 and 48 will move to the open air supply position in which resin flows from the line 50 and line 56 to the mixer 54 and a curing agent flows from the line 52 and 58 to the mixer 54 prior to the opening of valves 32 and 34, thereby preventing a blocking of the pump discharge. Before the shifting of the resin supplying, mixing chamber valves 46 and 48, a branch line 184 and the shuttle valve 156 operate to connect the air supply to the closing side of the ball valve actuator 150 to close the ball valve 84 and prevent the flow to or from the solvent tank. As soon as the valve 115 is moved to the "in" position in which resin and hardener flow to the mixer 54, valves 132 and 134 lose their air supply and are deactivated so as to prevent the accidental injection of solvent or air into the resin mixture while spraying is in progress. The resin and hardening agent are mixed in the static mixer 54 and discharged through the spray nozzles of the spray manifold 60.

When spraying is completed, or when it is necessary to interrupt the spray operation for any reason, valve 115 is moved to the recirculate or "out" position described above, thereby closing off the flow of resin and hardener to the mixer and diverting the pump outputs to circulate the resin and hardener as described above. Air pressure will now be supplied to the solvent supply actuator valve 132 and to the air supply actuator valve 134 via lines 120, 140 and 160, while a branch line 158 will shift the shuttle valve 156 and will maintain the ball valve 84 in the closed position.

As soon as the spraying is completed, the operator will push the air supply actuator valve 134, thereby opening a large bore air purge release valve 108 to allow compressed air from the compressor 100 to flow through the check valve 110 via line 106, and through the opened valves 46 and 48 to force mixed resin out of the mixer 54 and spray manifold 60. After a few seconds most of the mixed resin will have been forced out of the mixer and spray head and valve 134 is released and solvent supply actuator valve 132 is depressed to inject a resin solvent to the mixer and spray head. With valve 132 depressed, the air supply is admitted to the solvent tank 83 via lines 142 and 146 to pressurize the tank. At the same time, a branch line 152 applies pressure to open the ball valve actuator 150 to release ball valve 84. When the pressure in tank 83 is sufficient, the ball valve 84 will open and the solvent will be forced through the static mixer into the spray manifold and out through the spray nozzles, thereby cleaning any resin residue. The check valve 110 prevents the flow of solvent back into the air supply system. The activation of valve 132 diverts the air supply away from valve 134, thereby deactivating it and preventing the accidental release of purge air while the system is being flushed with solvent. When the solvent flush is completed, the valve 132 is released, thereby closing the ball valve 84, releasing the pressure in the solvent tank 83 (which is vented through quick exhaust valve 144), and reactivating the air purge valve 134. A second air purge will eliminate any residue of solvent or resin remaining in the mixer and spray manifold, whereupon the cycle is complete and the machine is ready for re-use.

I claim:

1. A mobile apparatus for applying a two component resin to a roadway surface, comprising:

(a) means for moving the apparatus along a roadway at a controlled speed;

(b) application means for mixing and applying the resin to the roadway surface comprising a mixing chamber and a distributor means connected to the mixing chamber for evenly distributing mixed resin across the roadway;

(c) means for separately supplying the two components of the resin to the mixing chamber comprising, for each component, a storage chamber for the component, and a pump connected to the storage chamber for pumping the component into the mixing chamber;

(d) means for purging the mixing chamber comprising a solvent supply, a solvent supply actuator valve (132) for controlling the connection of the solvent supply to the mixing chamber and to the distributor means, a source of compressed air, and an air supply actuator valve (134) for controlling the connection of the source of compressed air to the mixing chamber;

(e) a pneumatic-flow control valve (115) movable between a supply position in which the pump outputs are connected to the mixing chamber and a purge position in which the pump outputs are recirculated to the supply chambers and the mixing chamber is connected to the means for purging the mixing chamber and distributor means;

(f) means responsive to the position of the pneumatic-flow control valve for deactivating both the solvent supply actuator valve and the air supply actuator valve when the pneumatic-flow control valve is in the supply position, so as to prevent the accidental injection of either solvent or air into the resin; and (g) means responsive to activation of the solvent supply actuator valve for deactivating the air supply actuator valve when solvent is being supplied to the mixing chamber.

2. The apparatus of claim 1, including a source (70) of cooling fluid, and fluid circulating means (72, 74, 76, 78 and 80) for circulating the cooling fluid in heat exchange relationship with the two components of the resin for cooling the resin components as they are pumped by said pumps.

3. The apparatus of claim 2, wherein said fluid circulating means is thermostatically controlled to maintain the temperature of the resin component within predetermined limits.

4. The apparatus of claim 1, wherein the solvent supply comprises a pressure vessel adapted for storage of solvents, said pressure vessel having an outlet connected to the mixing chamber, means for pressurizing said pressure vessel with compressed air from said source of compressed air, and a pneumatically actuated valve (84) in said outlet for controlling the flow of solvent to the mixing chamber, thereby to permit solvent to flow to the mixing chamber responsive to a sufficient pressure being developed within said pressure vessel to open said pneumatically actuated valve.

5. The apparatus of claim 1, wherein said pneumatic-flow control valve accesses a separate supply passage (28, 50 or 30, 52, respectively) from the outlet of each pump to the mixing chamber, a diverter valve (32 or 34, respectively) in each passage downstream of the associated pump, each of said diverter valves being movable between a supply position in which the output of the associated pump is supplied to the mixing chamber, and a recirculate position in which the output of the associated pump is returned to the component storage chamber, the diverter valves being coupled to an actuator so that they change position in unison, a mixing chamber valve (46 or 48, respectively) in each supply passage downstream of the diverter valve, each mixing chamber valve being movable between a supply position in which the output of the associated pump is supplied to the mixing chamber, and a purge position in which the supply passage from the associated pump is closed and the mixing chamber is connected to the means for purging the mixing chamber, the mixing chamber valves being coupled to an actuator so that they change position in unison, and manually controlled and automatically regulated means for sequentially moving the mixing chamber valves and then the diverter valves to their supply positions and for subsequently sequentially moving the diverter valves to their recirculate positions and then moving the mixing chamber valves to their purge positions.

6. The apparatus of claim 5, wherein the manually controlled means for moving the mixing chamber valves and the diverter valves is a pneumatic actuating system comprising a source of compressed air, air actuators attached to each of the mixing chamber valves and to the diverter valves, the actuators on the diverter valves being quicker acting when moving toward the recirculate position than when moving toward the supply position, and the actuators attached to the mixing chamber valves being quicker acting when moving toward the supply position than when moving toward the purge position, and the pneumatic flow control valve (115) is between the source of compressed air and the actuators for either supplying compressed air to said actuators simultaneously to move the diverter valves to their recirculate positions and the mixing valves to their purge positions, or supplying compressed air to the actuators simultaneously to move the diverter valves and the mixing chamber valves to their supply positions.

7. The apparatus of claim 6, wherein the source of compressed air comprises an air compressor and storage tank, the storage tank having an outlet connected to the mixing chamber, and a pneumatically operated air purge release valve (108) in said outlet for controlling the flow of compressed air to the mixing chamber.

8. The apparatus of claim 6, wherein the solvent supply actuator valve (132), and the air supply actuator valve (134) are pneumatic manually operated control valves which are each spring loaded in a closed position in which the compressed air supply and the solvent supply are not connected to the mixing chamber, and which are each independently movable to an open position, the solvent supply actuator valve being effective in its open position to allow solvent to flow to the mixing chamber, and the air supply actuator valve being effective in its open position to allow compressed air to flow to the mixing chamber.

9. The apparatus of claim 8, wherein the pneumatic flow control valve, the solvent supply actuator valve, and the air supply actuator valve are serially positioned downstream of the compressed air supply, and movement of the pneumatic-flow control valve to the component supply position deactives both the solvent supply actuator valve and the air supply actuator valve by diverting the air supply away from the solvent supply actuator valve and the air supply actuator valve.

10. The apparatus of claim 9, wherein the movement of the solvent supply actuator valve to the open position deactivates the air supply actuator valve by diverting air away from the air supply actuator valve.

* * * * *